United States Patent [19]

Pali

[11] Patent Number: 4,564,151

[45] Date of Patent: Jan. 14, 1986

[54] CORE LATCH CHUCK ASSEMBLY

[75] Inventor: Christopher Pali, Fort Wayne, Ind.

[73] Assignee: Essex Group, Inc., Fort Wayne, Ind.

[21] Appl. No.: 617,310

[22] Filed: Jun. 4, 1984

[51] Int. Cl.[4] ..... B65H 75/24; B65H 19/12

[52] U.S. Cl. ..... 242/68.3; 242/72 R; 279/2 R

[58] Field of Search ..... 279/2 R; 242/72 R, 68.2, 242/68.3

[56] References Cited

U.S. PATENT DOCUMENTS

| | | | |
|---|---|---|---|
| 2,116,735 | 5/1938 | Stevens | 242/68.3 |
| 2,734,691 | 2/1956 | Godat | 279/2 R |
| 2,898,137 | 8/1959 | Kreske | 242/68.3 X |
| 2,942,892 | 6/1960 | Nelson | 242/72.1 X |
| 2,983,460 | 5/1961 | Wright | 242/68.3 |
| 3,565,361 | 7/1969 | Merrill | 242/72 |
| 3,596,846 | 8/1971 | Johnston | 242/72.1 X |
| 3,645,463 | 2/1972 | Helm | 242/58.1 |
| 3,704,837 | 12/1972 | Heinz | 242/68.2 |
| 3,995,791 | 12/1976 | Schoppee | 242/58.1 |
| 4,366,932 | 1/1983 | Focke | 242/68.3 X |

*Primary Examiner*—Donald Watkins
*Assistant Examiner*—Lloyd D. Doigan
*Attorney, Agent, or Firm*—Robert P. Hayter

[57] ABSTRACT

A core latch chuck assembly for securing a roll of wound material having an annular core for rotational movement is disclosed. The assembly includes a casing sized to fit within the annular core and a plurality of latches having a first position secured within the casing and a second locking position wherein the latches engage the interior surface of the core and include an extension portion extending beyond the core to prevent telescoping of the inner layers of the roll of wound material.

9 Claims, 2 Drawing Figures

CORE LATCH CHUCK ASSEMBLY

BACKGROUND OF THE INVENTION

The present invention relates to a core latch chuck assembly for securing a roll of wound material having an annular core for rotational movement. More particularly the present invention concerns a core chuck assembly having latches capable of being rotated to a first withdrawn position such that they may be inserted through the annular core of a roll of material and a second locking position wherein they are extended outwardly engaging the interior surface of the core and having an extension portion extending to cover the inner wraps of the roll material to prevent the material from telescoping.

When a large roll of material such as paper is unwound it has been found that if the inner layers of the roll are loose they may "telescope". By "telescope" it is meant that the inner layers will actually be displaced axially outwardly such that the bulk of the roll of material will be displaced to a position other than radially outward from the annular core. This axial displacement continues until the strength of the paper is incapable of supporting the weight of the roll as it is displaced further and further from the core. Eventually the roll collapses.

In order to maintain an effective roll unwinding mechanism it is necessary to prevent this telescoping to prevent the potential for the entire roll to collapse. Once the roll collapses it is essentially unusable for unwinding and a new roll must be mounted. A process or end use receiving paper from the roll may have to be discontinued while the collapsed roll is removed and a new roll mounted.

The core chuck assembly described is capable of being entirely withdrawn from the center of the core of the paper roll such that the paper roll may simply drop from the mounting position upon withdrawal of the core latch chuck assembly. Once a new roll is placed in position the core latch chuck assembly is inserted through the core and the latches are rotated to both engage the interior of the core to secure the roll core and to project an extension portion to cover the radially extending face of the roll to prevent the innermost layers of material from telescoping.

SUMMARY OF THE INVENTION

It is an object of the present invention to provide a core latch chuck assembly for securing a roll of wound material for rotational movement.

It is a further object of the present invention to provide a core latch chuck assembly including latches capable of both securing the roll to the chuck assembly and capable of preventing telescoping of the inner layers of the roll of wound material.

It is a still further object of the present invention to provide a core latch chuck assembly capable of being entirely withdrawn from the roll of material to effect removal thereof.

It is a yet further object of the present invention to provide latches capable of being rotated to a locking position for securing the roll of material and for preventing telescoping of layers of the roll of material and for being rotated to a withdrawn position wherein they are secured within a casing defined by the core latch chuck assembly such that they may be removed and inserted through an annular core of the roll of wound material.

Another object of the present invention is to provide a safe, economical, reliable, and long-lasting mechanism capable of securing and unsecuring roll of wound material.

Other objects will be apparent from the description to follow and the appended claims.

According to the preferred embodiment of the present invention a core latch chuck assembly for securing a roll of wound material having an annular core for rotational movement is disclosed. The core latch chuck assembly includes a generally cylindrical casing sized to have a diameter of less than the internal diameter of the core, actuator means for slidably displacing the cylindrical casing between a mounting position wherein the casing extends within the core and an unloading position wherein the casing is removed from the core, at least one core latch pivotally mounted within the casing, said latch having a locking position wherein the latch extends from the casing to engage the roll and a withdrawn position wherein the latch is maintained within the casing, said latch additionally including gear teeth, a shaft slidably secured within the casing and including rack teeth mating with the gear teeth such that sliding motion of the shaft may cause the latch to rotate between the locking position and the withdrawn position.

Additionally disclosed is a core chuck assembly for securing a rotating roll of material having an annular core. This core chuck assembly includes a plurality of core latches pivotally mounted in a casing sized to fit within the annular core, said latches having a locking position wherein the latches engage the interior of the core and extend over a portion of the core to prevent inner loops of the core from telescoping and a withdrawn position wherein the latches are secured within the casing, said latches including gear teeth. Shaft means slidably mounted within the casing and including gear means coacting with the gear teeth of the core latches such that relative motion between the shaft and the casing may effect rotation of the core latches are additionally disclosed. An actuator means for slidably displacing the shaft to both rotate the core latches and to displace the casing including the latches is also provided.

DESCRIPTION OF THE PREFERRED EMBODIMENT

The core chuck assembly of a paper payoff assembly is utilized to secure a paper roll in position. The paper rolls as supplied sometimes have loose interior wraps which may result in telescoping such that the paper extends outwardly from the core and eventually collapses. The core latch chuck assembly as used herein was designed such that it may be completely withdrawn from the paper roll to allow the paper roll to drop to the floor after the paper roll has been depleted, and such that it may be freely inserted within the paper core without the core latch gear extending upwardly to engage the paper roll. The core chuck assembly further includes a core latch gear which extends outwardly engaging the core of the paper roll from the interior to secure same and includes a core latch gear extending outwardly on the side of the paper roll adjacent the robot assembly to prevent outward telescoping of interior wraps of the paper roll.

Figure 1:
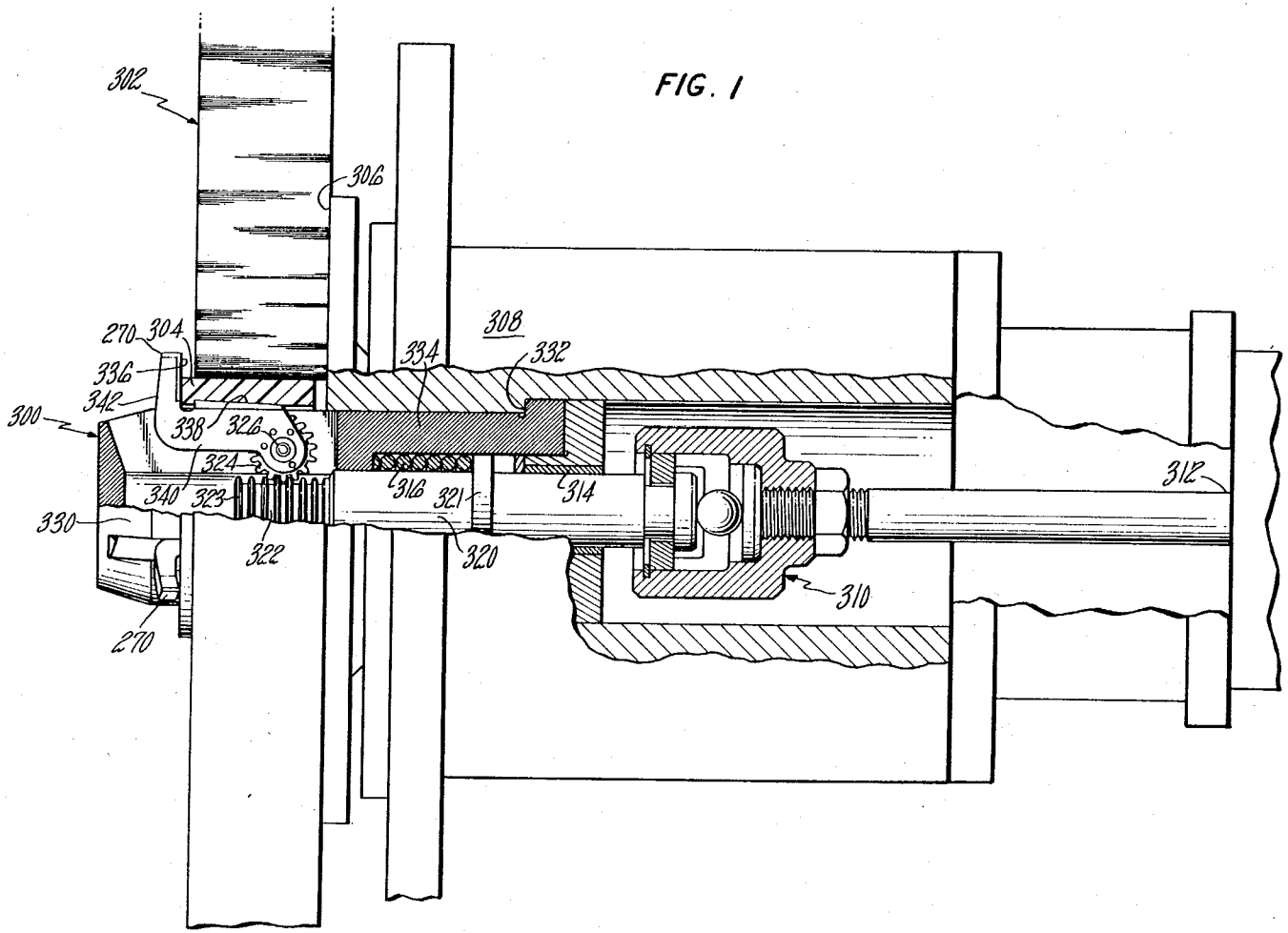
FIG. 1 is a partially schematic view of a core latch chuck assembly shown with the core latches in the mounting position securing the paper roll thereto.

Referring specifically to FIG. 1 it may be seen that paper roll 302 includes paper core 304. Core latch chuck assembly 300 is shown extending through the paper roll with core latch gear 270 extending outwardly having anti-telescoping face 336 mounted parallel to the paper roll to prevent the paper from being displaced away from frame 308. Core latch gear 270 additionally includes core engagement edge 338 which engages the interior surface of the paper core to secure the paper core relative thereto. Abutment face 306 is provided as part of the machine frame and serves to contain the paper roll from telescoping in the left-to-right direction. The anti-telescoping face 336 of the core latch gear serves a similar function preventing displacement of the paper in the right-to-left direction.

As can be seen in FIG. 1 core latch chuck assembly 300 includes an actuator 312 which may be an air powered cylinder for slidably displacing the entire assembly. It is to be understood that the core latch chuck assembly includes a portion which rotates with the paper roll and a portion which is secured to the machine. Rotary coupling 310 acts to separate actuator 312 which does not rotate from shaft 320 which does rotate. Rotary coupling 310 secures actuator 312 to shaft 320 to transmit sliding motion therebetween. Shaft 320 extends from the rotary coupling through bearing 314 and terminates in rack gear extension 322 which includes rack gear teeth 323 formed on the surface thereof. Spring 316 is mounted between shaft retainer 334 and shaft 320 and acts to bias the shaft toward the right as shown in the Figure by acting against shaft collar 321 projecting from the shaft. Additionally shaft retainer 334 includes abutment face 332 which may engage frame 308 to prevent further displacement of the core latch chuck assembly to the left. Core latch assembly casing 330 is shown at the bottom of the Figure.

Core latch gear 270 is shown mounted for rotational displacement on pin 326. Core latch gear 270 is connected to spur gear 324 which has teeth which engage rack gear teeth 323. Hence, upon relative movement between the rack gear and the spur gear the core latch gear is caused to rotate between the closed position as shown with the paper roll being held therebetween and the open position as shown in FIG. 2 with the gear being retracted within the core latch chuck assembly such that the assembly may be slid either into or out of the paper roll.

When it is desired to remove the core latch chuck assembly from the paper roll the actuator 312 moves to the right. Spring 316 places an expansion force between shaft retainer 334 and shaft collar 321. As actuator 312 moves to the right the shaft 320 moves to the right therewith. However, the spring acts to maintain shaft retainer 334 and core latch gear 270 in position until such time as the shaft collar 321 engages the edge of bearing 314 to cause the entire assembly to move to the right. During the time the shaft is moving to the right when the core latch gear is not moving to the right, rack gear 323 engages spur gear 324 to cause the core latch gear to rotate inwardly away from the paper core. Once the core latch gear has rotated inwardly the shaft collar engages the bearing to cause the entire assembly to move to the right thereby withdrawing the core latch chuck assembly from the core allowing it to drop to the ground.

Figure 2:
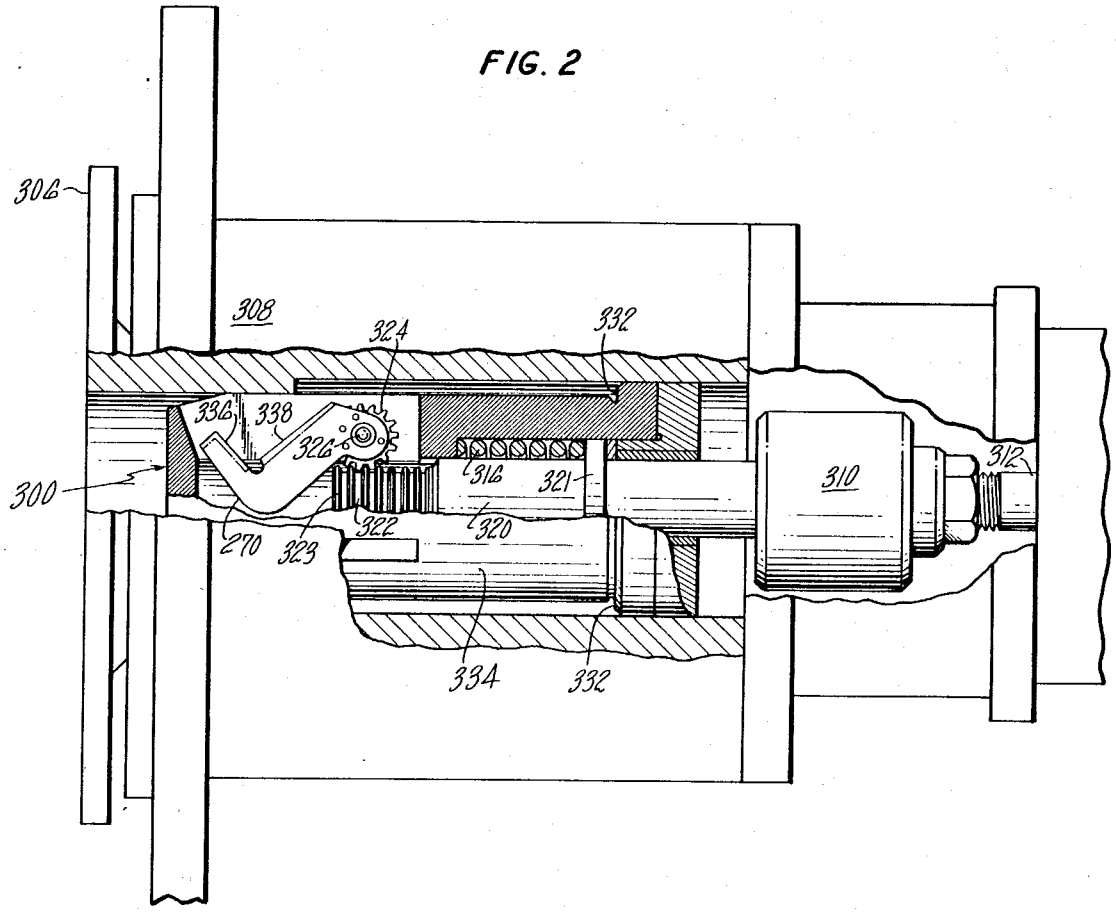
FIG. 2 is a partially sectional view of the core latch chuck assembly of FIG. 1 showing the latches in the withdrawn position secured within the casing.

FIG. 2 shows the core latch chuck assembly contained within the frame of the payoff assembly in position to be inserted into a paper roll. In this position the core latch gears are rotated to a position within the assembly casing and do not act to engage a paper roll. To mount the paper roll the robot assembly places the paper roll in position and actuator 312 then displaces the core latch gear from right to left. As the core latch gear travels from right to left, the assembly is inserted into the core until abutment face 332 engages frame 308 to prevent the entire assembly from moving further in the right to left direction. At this point the actuator continues to move from right to left and consequently the shaft is moved from right to left. The spring is compressed and the rack gear drives the spur gear to rotate the core latch gear outwardly to secure the paper roll in the desired position.

The invention has been described with reference to a particular embodiment. It is to be understood by those skilled in the art that variations and modifications can be effected within the spirit and scope of the invention.

I claim:

1. A core latch chuck assembly for securing a roll of wound material having an annular core for rotational movement which comprises:

a generally cylindrical casing sized to have a diameter less than the internal diameter of the core;

motion limiting means for slidably displacing the cylindrical casing between a mounting position wherein the casing extends within the core of the roll and an unloading position wherein the casing is removed from the core;

at least one core latch pivotally mounted within the casing, said latch having a locking position wherein the latch extends from the casing to engage the roll and a withdrawn position wherein the latch is maintained within the casing, said latch additionally including gear teeth;

a shaft slidably secured within the casing and including rack teeth mating with the gear teeth such that sliding motion of the shaft relative to the casing may cause the latch to rotate between the locking position and the withdrawn position; and actuator means connected to the shaft such that displacement of the actuator means results in displacement of the shaft, said shaft being connected to the casing by the motion limiting means for allowing relative motion between the shaft and the casing to effect positioning of the latch.

2. The apparatus as set forth in claim 1 and further comprising a pin mounted to the casing and extending through an opening in the latch for securing the latch for rotational displacement.

3. The apparatus as set forth in claim 1 wherein the core latch further comprises a body portion including an outwardly extending core engagement edge and an extension portion angled from the body portion and defining an anti-telescoping face extending radially outward to cover a portion of the roll to prevent telescoping of the inner layers of the roll.

4. The apparatus as set forth in claim 3 and further comprising spring means extending between the casing and the shaft, said spring means biasing the shaft to rotate the latch to the withdrawn position.

5. The apparatus as set forth in claim 4 wherein the casing defines an abutment face perpendicular to the direction of sliding motion of the casing, said abutment face engaging a structure to prevent the casing from further sliding displacement such that further motion of the actuator means causes relative motion to occur between the casing and the shaft effecting rotation of the latch and displacing the spring means.

6. The apparatus as set forth in claim 5 and further comprising a shaft collar extending from the shaft, said shaft collar being positioned to allow the shaft to be displaced prior to engagement of the shaft collar against the casing such that there is relative motion between the casing and the shaft which allows the latch to be rotated to the withdrawn position upon displacement by the actuator means, said spring means acting to prevent displacement of the casing until the shaft collar engages the casing.

7. A core chuck assembly for securing a rotating roll of material having an annular core which comprises:

a plurality of core latches pivotally mounted in a casing sized to fit within the annular core, said latches having a locking position wherein the latches engage the interior of the core and extend over a portion of the core to prevent inner loops of the core from telescoping and a withdrawn position wherein the latches are secured within the casing, said latches including gear teeth;

shaft means slidably mounted within the casing and including gear means coacting with the gear teeth of the core latches such that relative motion between the shaft and the casing may effect rotation of the core latches; and actuator means for slidably displacing the shaft to both rotate the core latches and to displace the casing including the latches; and motion limiting means connecting the shaft and the casing for allowing only limited relative motion between the shaft and the casing such that upon the actuator means sliding the shaft, the shaft and casing are displaced simultaneously except for when there is relative motion between the shaft and casing.

8. The apparatus as set forth in claim 7 and further comprising motion limiting means connecting the shaft and the casing for allowing only limited relative motion between the shaft and the casing such that upon the actuator means sliding the shaft, the shaft and casing are displaced simultaneously except for when there is relative motion between the shaft and casing.

9. The apparatus as set forth in claim 8 and further comprising biasing means for biasing the shaft relative to the casing to maintain the latches in the withdrawn position.

* * * * *